US008944634B1

(12) United States Patent
Cheng et al.

(10) Patent No.: US 8,944,634 B1
(45) Date of Patent: Feb. 3, 2015

(54) BULB TYPE APPARATUS AND BULB SOCKET

(71) Applicant: Azurewave Technologies, Inc., New Taipei (TW)

(72) Inventors: Yu-Ting Cheng, Hsinchu County (TW); Chee-Onn Ching, New Taipei (TW)

(73) Assignee: Azurewave Technologies, Inc., New Taipei (TW)

( * ) Notice: Subject to any disclaimer, the term of this patent is extended or adjusted under 35 U.S.C. 154(b) by 14 days.

(21) Appl. No.: 13/952,403

(22) Filed: Jul. 26, 2013

(51) Int. Cl.
*F21V 23/06* (2006.01)

(52) U.S. Cl.
CPC ..... *F21V 23/06* (2013.01)
USPC ..... 362/249.02; 362/311.02

(58) Field of Classification Search
USPC ..... 362/311.02, 249.02, 216
See application file for complete search history.

(56) References Cited

U.S. PATENT DOCUMENTS

| | | | | |
|---|---|---|---|---|
| 2011/0140589 | A1* | 6/2011 | Daniel | 313/110 |
| 2011/0163678 | A1* | 7/2011 | Shew | 315/159 |
| 2012/0230034 | A1* | 9/2012 | Boomgaarden et al. | 362/294 |
| 2012/0300455 | A1* | 11/2012 | Breidenassel et al. | 362/235 |
| 2013/0077285 | A1* | 3/2013 | Isogai et al. | 362/84 |
| 2013/0175916 | A1* | 7/2013 | Lin et al. | 313/46 |
| 2013/0176723 | A1* | 7/2013 | Yang et al. | 362/231 |
| 2013/0181607 | A1* | 7/2013 | Yotsumoto et al. | 315/70 |

* cited by examiner

*Primary Examiner* — Laura Tso
(74) *Attorney, Agent, or Firm* — Li & Cai Intellectual Property (USA) Office

(57) ABSTRACT

The bulb socket comprises a main body, a lighting module, and an adapter cover. The main body has a head portion and a carrying portion arranged on two opposite end portions thereof. The lighting module is fixed on the carrying portion of the main body and electrically connecting to the head portion. The adapter cover module has a translucent cover and a power supply. The translucent cover is disposed on the carrying portion of the main body for allowing light generated from the lighting module to go through the translucent cover. The translucent cover has a receiving compartment. The power supply unit is disposed on the receiving compartment and electrically connecting to the head portion. Thus, the bulb socket of the instant disclosure can be used for being inserted by an electronic device.

10 Claims, 7 Drawing Sheets

BULB TYPE APPARATUS AND BULB SOCKET

BACKGROUND OF THE INVENTION

1. Field of the Invention

The instant disclosure relates to a bulb; particularly to a bulb type apparatus and a bulb socket.

2. Description of Related Art

Generally, if a user wishes to install a conventional electronic device (e.g., gas sensor, camera, or monitor) to the ceiling, the installation of the conventional electronic device usually causes a lot of inconvenience and damages the original ceiling appearance. When the user needs to remove the electronic device from the original position of the ceiling, the original position of the ceiling is damaged and a lack of coordination with the surrounding appearance shows after removing the electronic device from the original position of the ceiling.

Specifically, a bulb socket is usually disposed on the ceiling, and a conventional light bulb is inserted into the bulb socket to provide lighting purpose without other functions. However, the position of the light bulb (i.e., the position of bulb socket) is the existing layout and design of the ceiling, so that a conventional electronic device may also be installed into the position of the bulb socket.

To achieve the abovementioned improvement, the inventors strive via industrial experience and academic research to present the instant disclosure, which can provide additional improvement as mentioned above.

SUMMARY OF THE INVENTION

One embodiment of the instant disclosure provides a bulb type apparatus and a bulb socket for utilizing the void that accommodates a conventional bulb and remaining the lighting of the bulb socket simultaneously.

The bulb type apparatus in the instant disclosure comprises a bulb socket comprising: a main body having a head portion and a carrying portion arranged on two opposite end portions thereof; a lighting module fixed on the carrying portion of the main body and electrically connecting to the head portion; and an adapter cover module comprising: a translucent cover disposed on the carrying portion of the main body for allowing light generated from the lighting module to go through the translucent cover, wherein the translucent cover has a receiving compartment; and a power supply unit disposed on the receiving compartment and electrically connecting to the head portion; and an electronic device having a conductive terminal set, the electronic device detachably inserted into the receiving compartment of the translucent cover, and the conductive terminal set electrically connecting to the power supply unit, wherein the conductive terminal set is restricted with the receiving compartment to keep the relative position between the electronic device and the bulb socket.

Preferably, the bulb socket defines a central axis, the bulb socket is substantially symmetrical with reference to the central axis, and the electronic device is rotatable with respect to the bulb socket along the central axis.

The bulb socket in the instant disclosure comprises a main body having a head portion and a carrying portion arranged on two opposite end portions thereof; a lighting module fixed on the carrying portion of the main body and electrically connecting to the head portion; and an adapter cover module comprising: a translucent cover disposed on the carrying portion of the main body for allowing light generated from the lighting module to go through the translucent cover, wherein the translucent cover has a receiving compartment; and a power supply unit disposed on the receiving compartment and electrically connecting to the head portion.

In summary, the bulb socket in the instant disclosure emits light and provides the receiving compartment for accommodating the electronic device for supplying electrical energy to the electronic device. Thus, the void, which the bulb socket inserted into, is utilized effectively for preventing the problem generated from installing the conventional electronic device to the ceiling.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF THE PREFERRED EMBODIMENTS

First Embodiment

Figure 1:
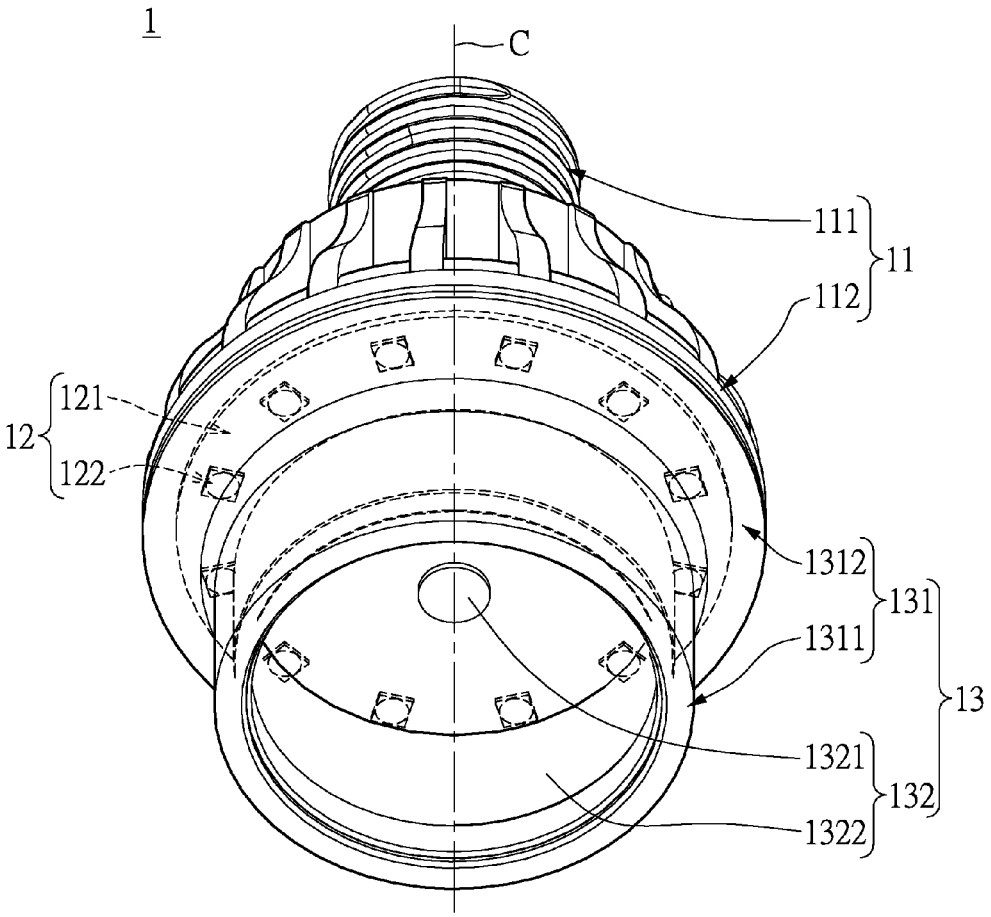
FIG. 1 is a perspective view of a bulb socket according to a first embodiment of the instant disclosure.
Figure 2:
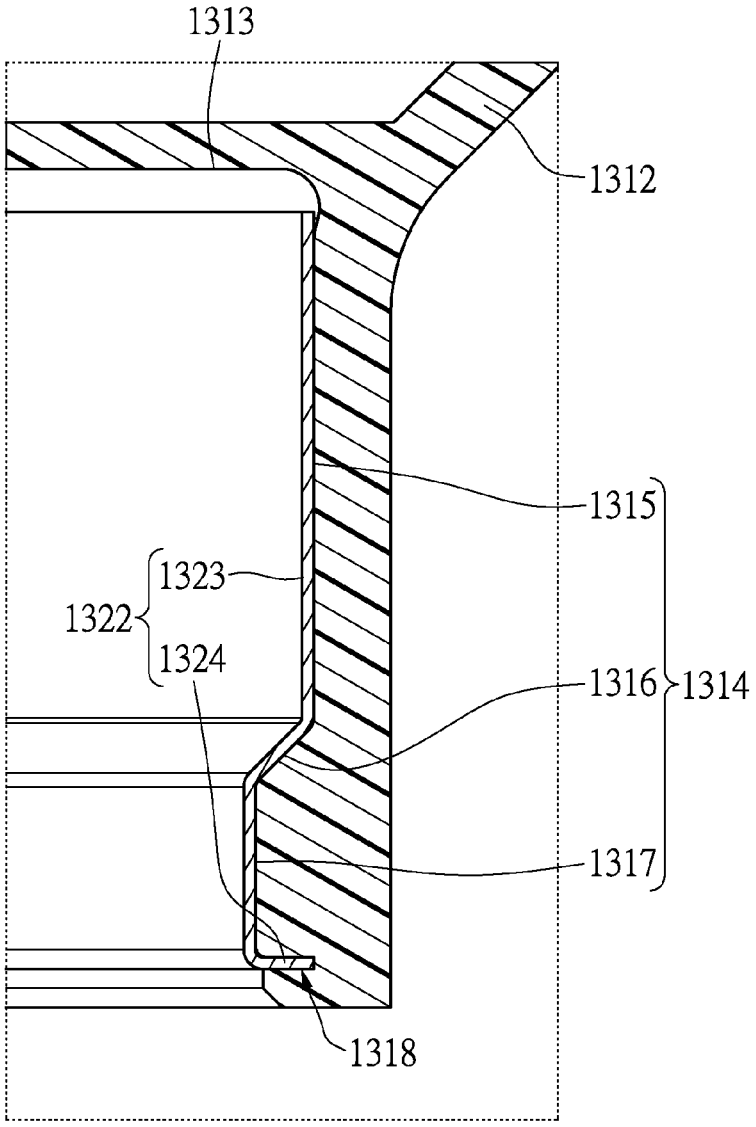
FIG. 2 is a partially cross-sectional view of the bulb socket according to the first embodiment of the instant disclosure.

Please refer to FIGS. 1 and 2, which show a first embodiment of the instant disclosure. The instant embodiment provides a bulb socket 1 having a main body 11, a lighting module 12, and an adapter cover module 13. The following description discloses the construction of the bulb socket 1 and the electrical relationship between the components of the bulb socket 1. Specifically, the electrical connection between the components of the bulb socket 1 (e.g., connecting two components by wire or circuit board) can be adjusted by the designer's demand, but the electrical connection is not limited to the instant embodiment.

The main body 11 has a head portion 111 and a carrying portion 112, which are arranged on two opposite end portions of the main body 11. For example, the head portion 111 is the top portion of the main body 11 as shown in FIG. 1, and the carrying portion 112 is the bottom portion of the main body 11 as shown in FIG. 1. The head portion 111 is used for inserting into a bulb socket (not shown), which is fixed on a ceiling, that is to say, the head portion 111 can be replaced according to the type of bulb socket. For example, the head portion 111 can be E type, B type, or G type, and the head portion 111 in the instant embodiment is E27 type. However, the head portion 111 is not limited thereto.

The lighting module 12 has a circuit board 121 and a plurality of LEDs 122 disposed on the circuit board 121. The circuit board 121 has a circular shape, and the contour of the circuit board 121 is smaller than the contour of the carrying portion 112. The LEDs 122 are disposed on the circuit board 121 in an annular arrangement. The circuit board 121 of the lighting module 12 is fixed on the carrying portion 112 of the main body 11, and a surface of the circuit board 121 without any LED 122 abuts against the carrying portion 112 for allowing the LEDs 122 to emit away from the head portion 111 (emit light toward the opposite direction of the head portion 111). The circuit board 121 of the lighting module 12 electrically connects to the head portion 111.

The adapter cover module 13 includes a translucent cover 131 and a power supply unit 132. The translucent cover 131 has a receiving compartment 1311 and a ring shaped connecting portion 1312 integrally extended from the receiving compartment 1311. The receiving compartment 1311 has a cylindrical shape. The connecting portion 1312 slantingly and outwardly extends from the periphery of the bottom portion of the receiving compartment 1311 along a direction, which is away from an opening of the receiving compartment 1311. The contour of an end of the connecting portion 1312 is substantially identical to the contour of the carrying portion 112, that is to say, the contour of the end of the connecting portion 1312 is larger than the contour of the circuit board 121.

Specifically, the receiving compartment 1311 has a circular bottom wall 1313 and a tubular surrounding wall 1314 perpendicularly connecting to the periphery of the bottom wall 1313. The surrounding wall 1314 has a device contacting portion 1315, a device positioning portion 1316, and an extended portion 1317, which are arranged from the bottom wall 1313 and in sequence.

The device contacting portion 1315 is substantially parallel to the extended portion 1317, and the inner diameter of the device contacting portion 1315 is larger than the inner diameter of the extended portion 1317. The device positioning portion 1316 connects between the device contacting portion 1315 and the extended portion 1317, and the inner diameter of the device positioning portion 1316 gradually reduces from the device contacting portion 1315 to the device positioning portion 1317. Moreover, the translucent cover 131 has an annular groove 1318 formed on an inner side of the device positioning portion 1316 of the surrounding wall 1314.

The power supply unit 132 is coupled to the receiving compartment 1311 of the translucent cover 131, and the power supply unit 132 electrically connects to the head portion 111. The power supply unit 132 includes an end electrode 1321 and an annular electrode 1322. The end electrode 1321 is disposed on a center region of the bottom wall 1313 of the receiving compartment 1311, the annular electrode 1322 is disposed on the surrounding wall 1314, and the annular electrode 1322 and the end electrode 1321 are spaced apart. Moreover, the annular electrode 1322 and the end electrode 1321 are electrically connected to the head portion 111 by direct connection or indirect connection, but the connection manner is not limited in the instant disclosure.

Specifically, the annular electrode 1322 resembles a sheet, the annular electrode 1322 includes a contacting portion 1323 and a positioning portion 1324 integrally and angularly extended from one end of the contacting portion 1323. The outer surface of the contacting portion 1323 of the annular electrode 1322 substantially conforms with the surrounding wall 1314 of the receiving compartment 1311, and the contacting portion 1323 substantially abuts against the device contacting portion 1315, the device positioning portion 1316 and at least partial extended portion 1317 (i.e., the segment of the extended portion 1317 located between the groove 1318 and the device positioning portion 1316). The positioning portion 1324 of the annular electrode 1322 inserts into the groove 1318.

The end of the connecting portion 1312 of the translucent cover 131 is fixed on the carrying portion 112 of the main body 11, and the lighting module 12 is approximately arranged in a space, which is jointly defined by the translucent cover 131 and the carrying portion 112, such that light generated from the LEDs 122 of the lighting module 12 can pass through the translucent cover 131 for lighting. The annular electrode 1322 and the end electrode 1321 can be formed in transparent type for preventing the reduction of lighting effect of the bulb socket 1 from arrangement of the power supply unit 132.

In summary, the bulb socket 1 in the instant embodiment has the lighting function and provides an electronic device to insert into the receiving compartment 1311 thereof for supplying electrical energy to the electronic device. Moreover, the bulb socket 1 defines a central axis C, and the bulb socket 1 is substantially symmetrical to the central axis C. The electronic device is rotatable with respect to the bulb socket 1 along the central axis C by the mating structure design of the bulb socket 1 and the electronic device.

Additionally, the power supply unit 132 of the instant embodiment is configured to cause the electronic device to be rotatable with respect to the bulb socket 1, but the power supply unit 132 is not limited thereto. For example, the power supply unit can just have two half-ring shaped electrodes (not shown), or the power supply unit can be designed for causing the electronic device to be unrotatable with respect to the bulb socket (not shown).

Second Embodiment

Please refer to FIGS. 3 through 7, which show a second embodiment of the instant disclosure. The instant embodiment provides a bulb type apparatus 100 including the bulb socket 1 disclosed in the first embodiment and an electronic device 2. The construction of the bulb socket 1 is disclosed in the first embodiment, so the instant embodiment does not repeat again. The following description discloses the construction of the electronic device 2 and the relationship between the bulb socket 1 and the electronic device 2.

Figure 3:
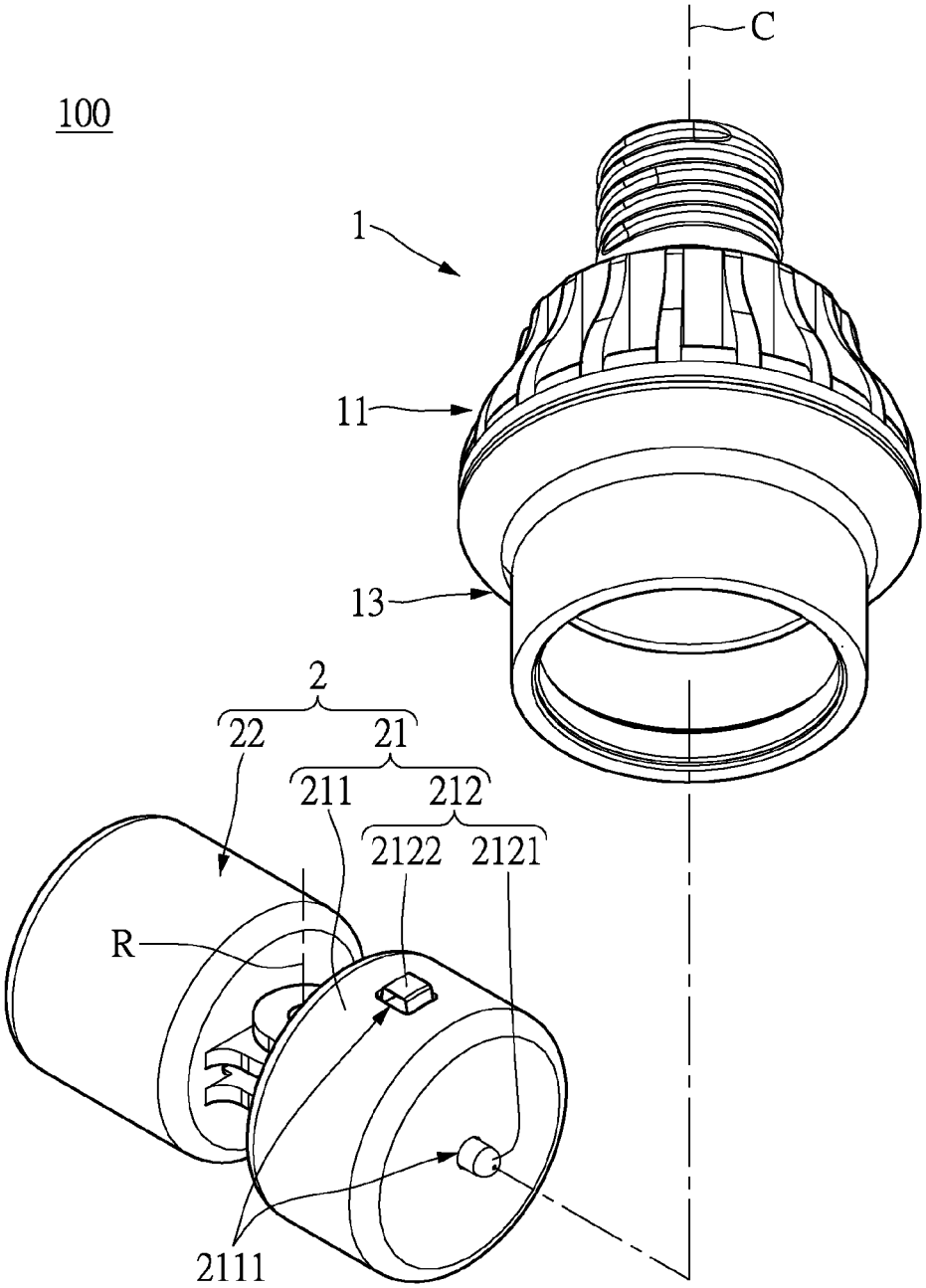
FIG. 3 is an exploded view of a bulb type apparatus according to a second embodiment of the instant disclosure.
Figure 4:
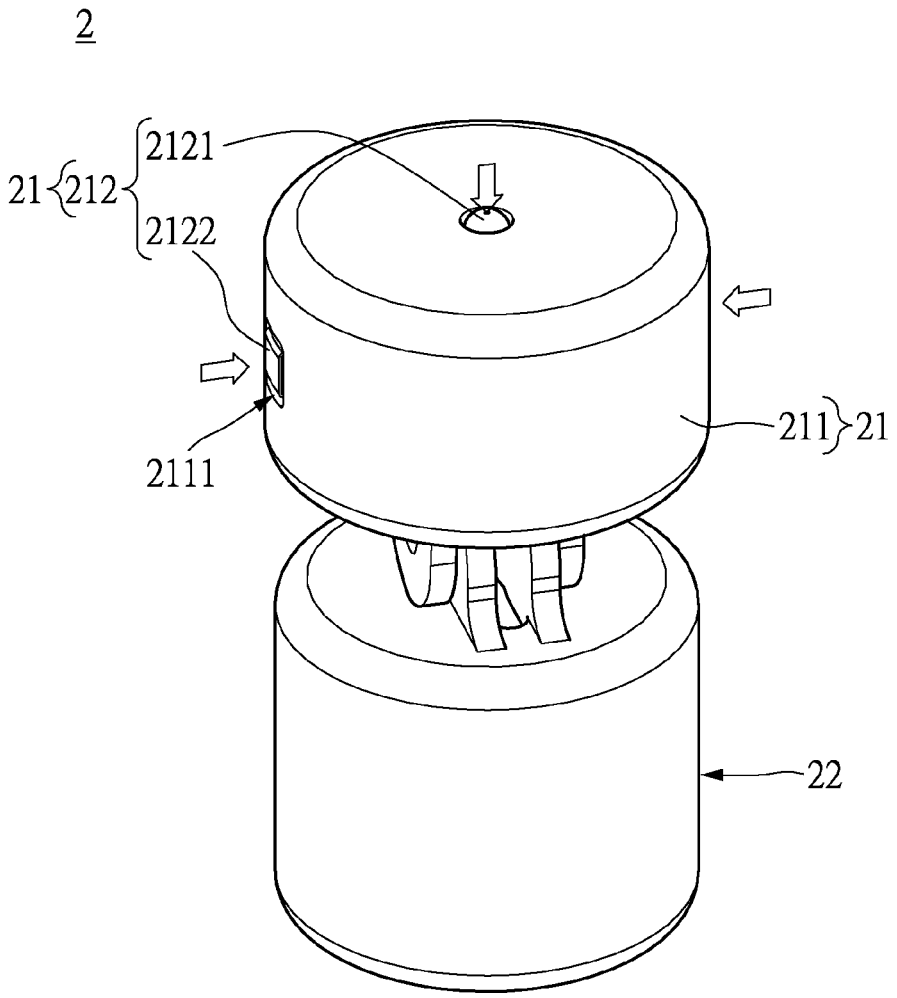
FIG. 4 is a perspective view of the bulb type apparatus when a conductive terminal set of an electronic device is compressed according to the second embodiment of the instant disclosure.
Figure 6:
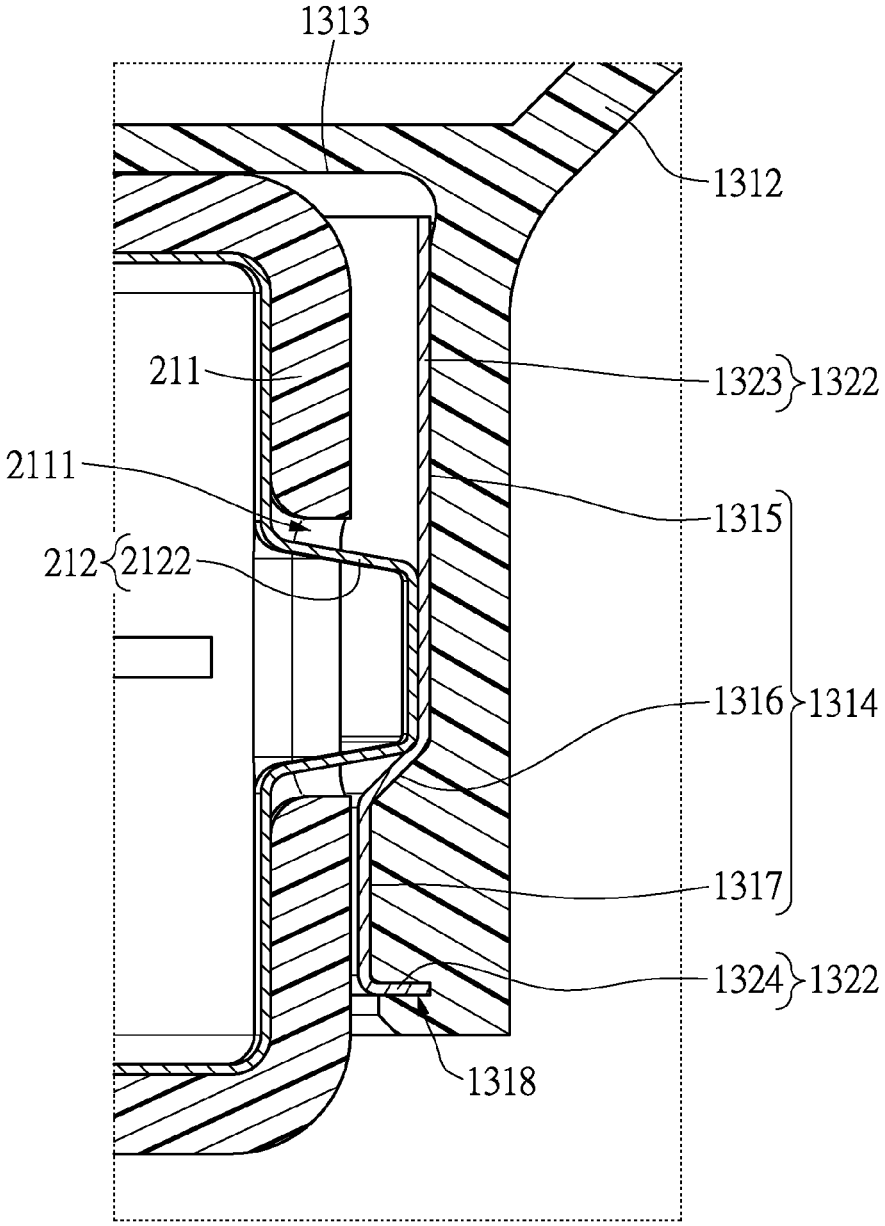
FIG. 6 is a partially cross-sectional view of the bulb type apparatus according to the second embodiment of the instant disclosure.

Please refer to FIGS. 3, 4, and 6. The electronic device 2 includes a connection member 21 and an operating member 22. The operating member 22 is pivotally connected to the connection member 21 along a rotational axis R, such that the operating member 22 is rotatable with respect to the connection member 21 along the rotational axis R. The operating member 22 can be wireless monitor, wireless camera, gas sensor (i.e., carbon-dioxide sensor or toxic gas sensor), or the other suitable component. The operating member 22 in the instant embodiment takes the wireless monitor for example, but the operating member 22 is not limited thereto.

The connection member 21 has a casing 211 and a conductive terminal set 212. The casing 211 has an approximately cylindrical shape, and the outer diameter of the casing 211 is slightly smaller than the smallest inner diameter of the contacting portion 1323 of the annular electrode 1322. The casing 211 has a plurality of openings 2111. The conductive terminal set 212 is arranged inside the casing 211 and is electrically connected to the operating member 22, and the conductive terminal set 212 is retractable within the openings 2111 of the casing 211. The conductive terminal set 212 is retractable in the openings 2111 by disposing a resilient component (i.e., spring) or capable of being a resilient (i.e., the conductive terminal set 212 is bent to has an elastic function), and the detail construction is not disclosed in the instant embodiment.

Specifically, the conductive terminal set 212 includes a bottom terminal 2121 and two side terminals 2122 (the figures only shows one side terminal 2122 for explaining). The bottom terminal 2121 has a pillar shape, and the bottom terminal 2121 is disposed on a portion of the casing 211 away from the operating member 22. Each side terminal 2122 is a bent strip. The side terminals 2122 are arranged on two opposite portion of the casing 211 (e.g., the bottom portion and the top portion of the casing 211 as shown in FIG. 3). Moreover, an end portion of the bottom terminal 2121 and a protruding portion of each terminal 2122 protrude out of the casing 211 via the corresponding openings 2111. When the end portion of the bottom terminal 2121 and the protruding portion of each terminal 2122 are pressed, the end portion of the bottom terminal 2121 and the protruding portion of each terminal 2122 move into the casing 211. When the end portion of the bottom terminal 2121 and the protruding portion of each terminal 2122 are not pressed, the end portion of the bottom terminal 2121 and the protruding portion of each terminal 2122 return to the original position and are exposed from the casing 211 via the corresponding openings 2111.

The above description has disclosed the construction of the electronic device 2, and the following description discloses the relationship between the bulb socket 1 and the electronic device 2. Please refer to FIGS. 3, 5, and 6, and with reference occasionally made to FIGS. 1 and 2. The electronic device 2 is detachably inserted into the receiving compartment 1311 of the adapter cover module 13 of the bulb socket 1 along the central axis C, where the conductive terminal set 212 is electrically connected to the power supply unit 132, and the conductive terminal set 212 is positioned by the receiving compartment 1311 for keeping the relative position between the electronic device 2 and the bulb socket 1.

Moreover, the connection member 21 is arranged in the receiving compartment 1311, the rotational axis R is perpendicular to the central axis C, the bottom terminal 2121 abuts against the end electrode 1321, and the side terminals 2122 abuts against the annular electrode 1322, so that the electronic device 2 can be in electrical communication with the bulb socket 1 by the connection of the power supply unit 132 and the conductive terminal set 212.

Specifically, the protruding portion of each side terminal 2122 is approximately arranged between the bottom wall 1313 and the device positioning portion 1316 of the surrounding wall 1314, and the protruding portion of each side terminal 2122 abuts against the device contacting portion 1323 of the annular electrode 1322, such that the protruding portion of each side terminal 2122 secures the electronic device 2 in its correct position in the bulb socket.

Moreover, the device positioning portion 1316 and the contacting portion 1323 confine the movement of the protruding portion of each side terminal 2122. The contact force between the side terminals 2122 and the annular electrode 1322 is generated from the weight of the electronic device 2, and the weight of the electronic device 2 is not large enough to cause the protruding portion of each side terminal 2122 to retract back into the casing 211, so that the electronic device 2 is positioned with the bulb socket 1 by cooperation between the side terminals 2122 and the receiving compartment 1311.

Figure 5:
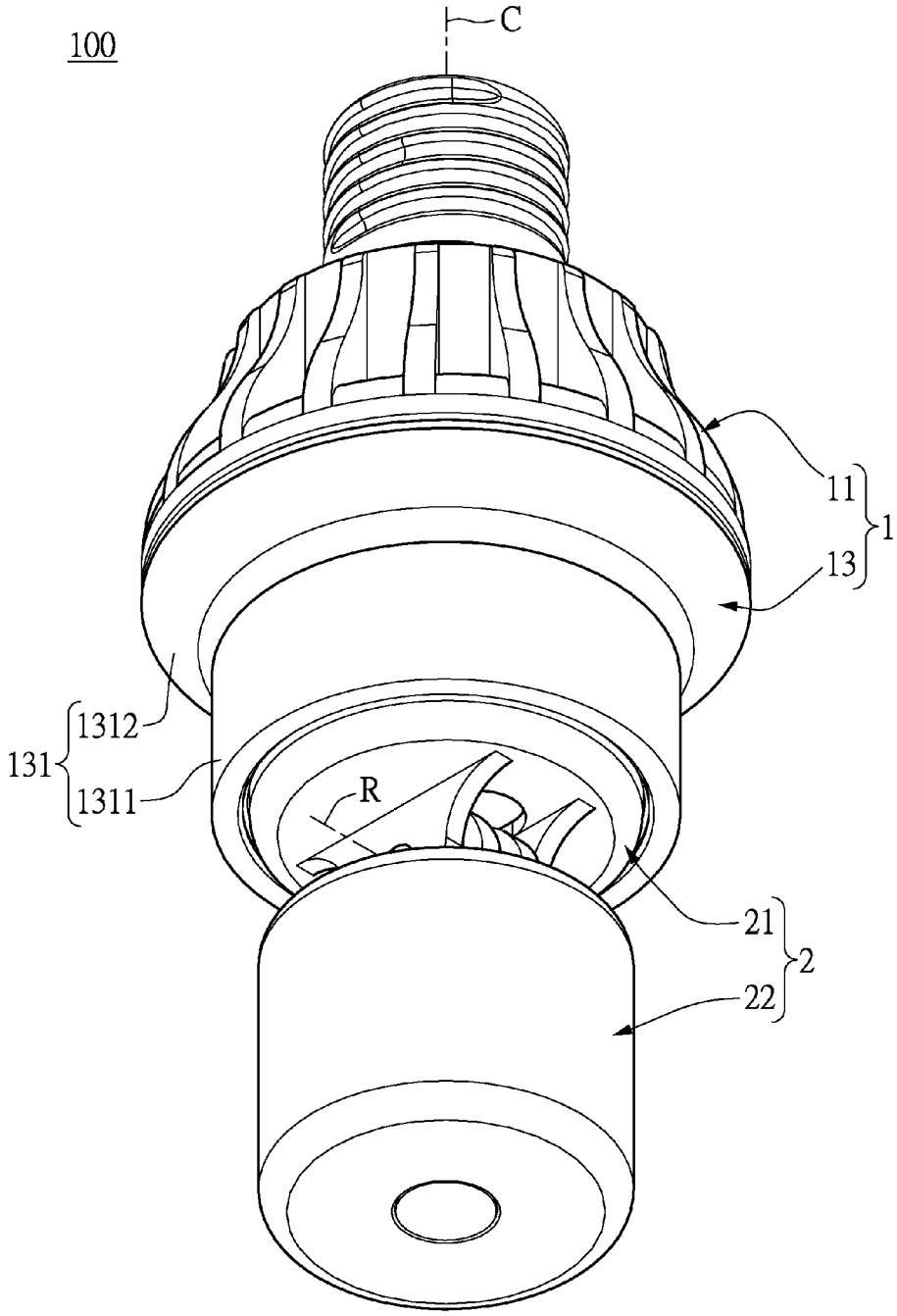
FIG. 5 is a perspective view of the bulb type apparatus according to the second embodiment of the instant disclosure.
Figure 7:
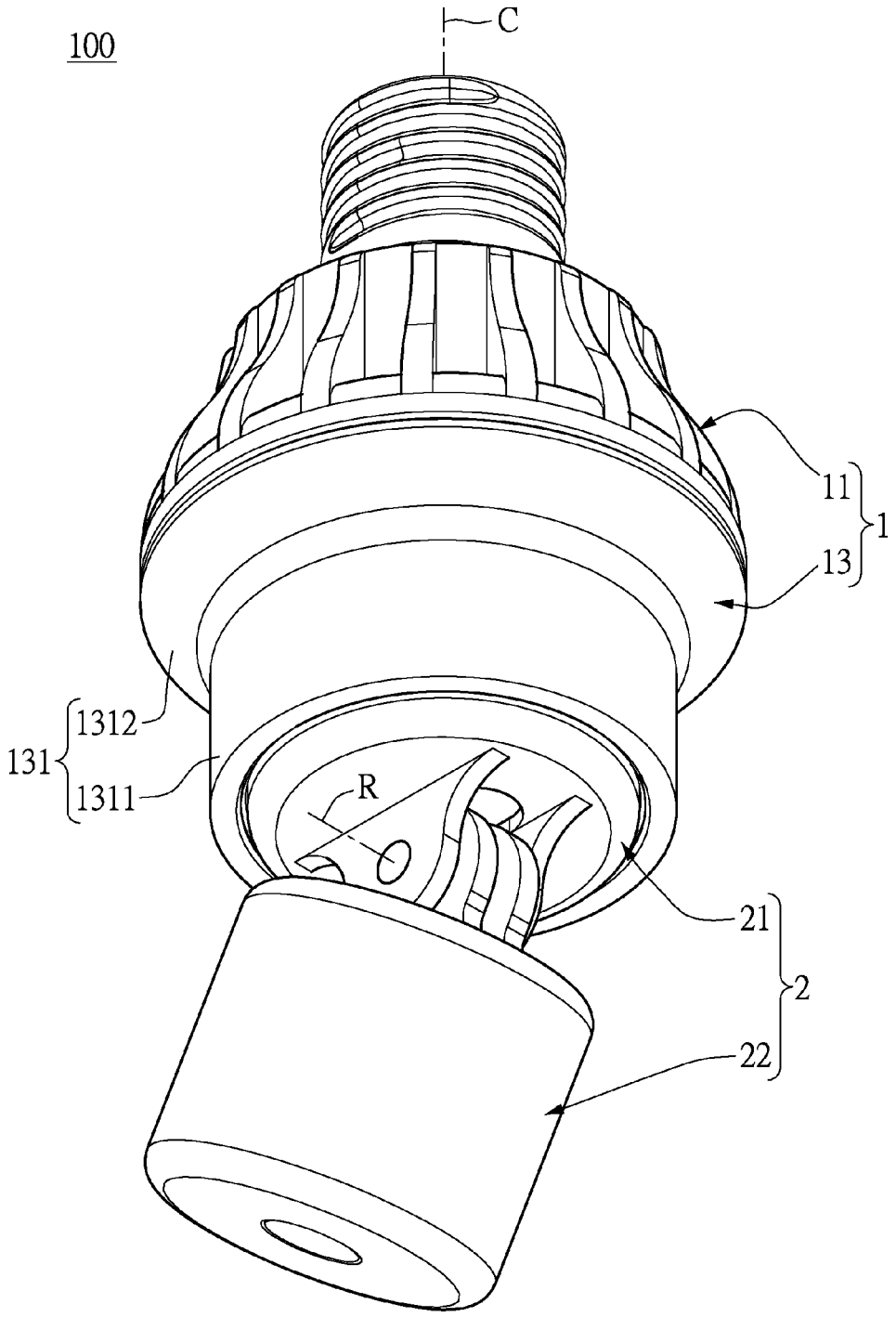
FIG. 7 is a perspective view of the bulb type apparatus when the electronic device rotates with reference to the bulb socket according to the second embodiment of the instant disclosure.

Please refer to FIGS. 5 and 7. The electronic device 2 is rotatable with respect to the bulb socket 2 along the central axis C. During the rotation of the electronic device 2, the positions of the bottom terminal 2121 and the end electrode 1321 remain still. Meanwhile, the bottom terminal 2121 continues to abut against the end electrode 1321, and the side terminals 2122 rotate along the annular electrode 1322 and maintain the connection with the annular electrode 1322, so that the bulb socket 1 provides electricity to the electronic device 2.

In addition, a rechargeable battery (not shown) can be disposed in the electronic device 2, such that the rechargeable battery is charged by the bulb socket 1 when the bulb socket 1 is turned on, and the rechargeable battery provides electrical energy to the electronic device 2 when the bulb socket 1 is turned off.

Moreover, the electronic device 2 in the instant embodiment takes two pieces (e.g., the connection member 21 and the operating member 22) pivoting with each other for example, but the electronic device 2 can be formed in another type according to the designer's demand, such as one piece structure.

Additionally, the conductive terminal set 212 is retractable within the openings 2111 of the casing 211, allowing the conductive terminal set 212 to be inserted into the receiving compartment 1311, but the conductive terminal set 212 is not limited thereto. For example, the side terminal 2122 can be non-resilient (i.e., the protruding portion of each side terminal 2122 cannot move into the casing 211), and the translucent cover 131 has two channels concavely formed from the opening thereof and penetrated to the device positioning portion 1316, such that the side terminals 2122 can be arranged in the translucent cover 131 via the channels, and then the electronic device 2 is rotated to cause the protruding portion of each side terminal 2122 to be confined by the device positioning portion 1316 and abutting against the annular electrode 1322.

[the Possible Effects of the Instant Embodiment]

In summary, the bulb socket in the instant disclosure has the lighting function and provides the electronic device to be inserted into the receiving compartment thereof for supplying electrical energy to the electronic device, such that the electronic device can be used more easily and the position, which the bulb socket inserted into, is utilized effectively. In other words, the electronic device can be installed to any bulb socket, which is inserted into a bulb socket, for preventing the problem generated from installing the conventional electronic device to the ceiling.

Moreover, the end electrode and the annular electrode are configured to cause the electronic device to be rotatable with respect to the bulb socket for adjusting the electronic device. The electronic device is designed in two pieces (e.g., the connection member 21 and the operating member 22) pivoted with each other, such that the position of the electronic device can be adjusted more easily.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. A bulb type apparatus, comprising:

a bulb socket comprising:

a main body having a head portion and a carrying portion arranged opposite to the head portion;

a lighting module fixed on the carrying portion of the main body and electrically connecting to the head portion; and an adapter cover module comprising:

a translucent cover coupled to the carrying portion of the main body for allowing light generated from the lighting module to go through the translucent cover, wherein the translucent cover has a receiving compartment; and a power supply unit disposed in the receiving compartment and electrically connected to the head portion; and an electronic device having a conductive terminal set, the electronic device detachably disposed in the receiving compartment of the translucent cover, and the conductive terminal set electrically connected to the power supply unit;

wherein the bulb socket retains the electronic device via the cooperation of the conductive terminal set and the receiving compartment.

2. The bulb type apparatus according to claim 1, wherein the receiving compartment has a bottom wall and a surrounding wall connecting to the circumferential portion of the bottom wall, the power supply unit has an annular electrode and an end electrode, the annular electrode is disposed on the surrounding wall, the end electrode is disposed on the bottom wall, the annular electrode and the end electrode are spaced apart, the conductive terminal set has at least one side terminal and a bottom terminal, the side terminal abuts against the annular electrode, the bottom terminal abuts against the bottom electrode.

3. The bulb type apparatus according to claim 2, wherein the surrounding wall has a device contacting portion, a device positioning portion, and an extended portion arranged in sequence from the bottom wall, an inner diameter of the device contacting portion is larger than an inner diameter of the extended portion, the device positioning portion connects between the device contacting portion and the extended portion, the side terminal contacts the positioning portion and locks the electronic device in the bulb socket.

4. The bulb type apparatus according to claim 3, wherein the translucent cover has a groove formed on the device positioning portion of the surrounding wall, the annular electrode has a contacting portion and a positioning portion integrally extended from one end of the contacting portion, the contacting portion contacts the device contacting portion, the device positioning portion and partially of the extended portion, and the positioning portion inserts into the groove.

5. The bulb type apparatus according to claim 2, wherein the annular electrode and the end electrode are transparent.

6. The bulb type apparatus according to claim 1, wherein the bulb socket defines a central axis, the bulb socket is substantially symmetrical with reference to the central axis, the electronic device is rotatable with respect to the bulb socket along the central axis.

7. The bulb type apparatus according to claim 1, wherein the electronic device has a connection member and an operating member, the operating member is pivotally connected to the connection member along a rotational axis, the rotational axis is substantially perpendicular to the central axis, the connection member has the conductive terminal set, the connection member is disposed in the receiving compartment, and the conductive terminal set abuts against the power supply unit.

8. The bulb type apparatus according to claim 7, wherein the connection member includes a casing having a plurality of openings, the conductive terminal set is retractable in the openings of the casing.

9. A bulb socket, comprising:

a main body having a head portion and a carrying portion arranged on two opposite end portions thereof;

a lighting module fixed on the carrying portion of the main body and electrically connecting to the head portion; and an adapter cover module comprising:

a translucent cover disposed on the carrying portion of the main body for allowing light generated from the lighting module to go through the translucent cover, wherein the translucent cover has a receiving compartment; and a power supply unit disposed on the receiving compartment and electrically connecting to the head portion.

10. The bulb socket according to claim 9, wherein the receiving compartment has a bottom wall and a surrounding wall integrally extended from a periphery of the bottom wall, the power supply unit has an annular electrode and an end electrode, the annular electrode is disposed on the surrounding wall, the end electrode is disposed on the bottom wall, the annular electrode and the end electrode are in a spaced arrangement.

* * * * *